US008695265B2

(12) United States Patent
Dextraze

(10) Patent No.: US 8,695,265 B2
(45) Date of Patent: Apr. 15, 2014

(54) MOUNT FOR FIREARMS

(76) Inventor: Serge Dextraze, St. Jean-sur-Richelieu (CA)

( * ) Notice: Subject to any disclaimer, the term of this patent is extended or adjusted under 35 U.S.C. 154(b) by 0 days.

(21) Appl. No.: 13/359,922

(22) Filed: Jan. 27, 2012

(65) Prior Publication Data

US 2012/0131839 A1 May 31, 2012

Related U.S. Application Data

(62) Division of application No. 12/966,263, filed on Dec. 13, 2010, now Pat. No. 8,117,781, which is a division of application No. 12/401,041, filed on Mar. 10, 2009, now Pat. No. 7,870,689, which is a division of application No. 11/059,688, filed on Feb. 17, 2005, now Pat. No. 7,520,083.

(51) Int. Cl.
*F41G 3/06* (2006.01)

(52) U.S. Cl.
USPC ..... 42/115; 42/117; 42/146

(58) Field of Classification Search
USPC ..... 42/114, 115, 117, 127, 146
See application file for complete search history.

(56) References Cited

U.S. PATENT DOCUMENTS

| | | | | |
|---|---|---|---|---|
| 1,452,651 | A | 4/1923 | Norrlin | |
| 2,279,601 | A | 4/1942 | Trotter | |
| 2,501,289 | A | 3/1950 | Orndorff | |
| 2,814,118 | A | 11/1957 | Evans et al. | |
| 3,256,608 | A | 6/1966 | Neisius | |
| 3,732,642 | A | 5/1973 | Bray | |
| 4,026,054 | A * | 5/1977 | Snyder | 42/115 |
| 4,291,478 | A * | 9/1981 | Lough | 42/117 |
| 5,495,675 | A * | 3/1996 | Huang | 42/115 |
| 5,659,965 | A | 8/1997 | Thibodeau et al. | |
| 6,568,118 | B1 | 5/2003 | Teetzel | |
| 6,678,988 | B1 | 1/2004 | Poff, Jr. | |
| 7,870,689 | B2 * | 1/2011 | Dextraze | 42/126 |
| 2004/0244263 | A1 | 12/2004 | Pettersson et al. | |

FOREIGN PATENT DOCUMENTS

| | | |
|---|---|---|
| GB | 20243 | 6/1910 |
| GB | 18847 | 9/1911 |

OTHER PUBLICATIONS

Be Meyers—"Night Vision Lasers Cameras Homeland Security Surveilance Military"—catalogue product description for MK Ranger item #: 2400.
General Dynamics Armament and Technical Products—catalogue product description for Mk 19 40mm Grenade Machine Gun.
General Dynamics Armament and Technical Products—catalogue product description for M2HB 12.7mm Machine Gun.

* cited by examiner

*Primary Examiner* — Stephen M Johnson
(74) *Attorney, Agent, or Firm* — Norton Rose Fulbright Canada LLP

(57) ABSTRACT

A mount comprising a connecting portion attachable to a firearm, a first member connected to the connecting portion to be rotatable about a first axis, a second member connected to the first member to be rotatable about a second axis substantially perpendicular to the first axis, and an attachment system connected to the second member for receiving an accessory. Also, a mount attachable to a firearm and having a dampener system connected to base and body portions thereof, the dampener system acting to dampen a recoil force produced by the firearm. Further, a mount attachable to a firearm and allowing a first rotation varying an azimuth of an accessory and a second rotation varying an angle of elevation of the accessory, and control means adjusting the second rotation to obtain a desired value and automatically producing the first rotation to correct a lateral drift of the firearm.

9 Claims, 10 Drawing Sheets

MOUNT FOR FIREARMS

CROSS-REFERENCE TO RELATED APPLICATIONS

This application is a divisional of U.S. patent application Ser. No. 12/966,263, filed on Dec. 13, 2010, now U.S. Pat. No. 8,117,781, which is a divisional of U.S. patent application Ser. No. 12/401,041, filed on Mar. 10, 2009, now U.S. Pat. No. 7,870,689, which is a divisional of U.S. patent application Ser. No. 11/059,688, filed on Feb. 17, 2005, now U.S. Pat. No. 7,520,083.

BACKGROUND OF THE INVENTION

1. Field of the Invention

The present invention relates to firearms and, more particularly, to systems for mounting various accessories to firearms.

2. Background Art

It is well known to use various accessories, such as infrared and night vision scopes, laser spotters and the like, with firearms. In the case of small firearms, such accessories are typically mounted to an accessory mount directly securable to the firearm.

However, in the case of larger firearms producing a significant recoil force, such as the MK-19 grenade machine gun or the M-2HB machine gun, such accessories are usually mounted to an accessory mount securable to the cradle or another fixed support of the firearm. This eliminates the effect of the recoil force on the accessory, thus minimizing the risks of injury to the operator. One example of such a mount is the MK RANGER, which adapts to the MK-64 or MK-93 cradle used with the MK-19 grenade machine gun, and receives a laser. A disadvantage of such mounts is that the precision of the position of the accessories with respect to the firearm is influenced by the positioning of the firearm on the cradle or support.

Accordingly, there exists a need for an accessory mount for releasably securing at least one accessory directly on a firearm having a significant recoil force while minimizing the risks of injury to the operator.

Also, existing accessory mounts directly securable to firearms usually provide no adjustment, or a very limited adjustment, of an orientation of the accessory with respect to the firearm. Accordingly, there exists a need for an accessory mount for releasably securing at least one accessory directly on a firearm while allowing adjustment of the accessory with respect to the firearm about at least two axes.

Moreover, some firearms have a lateral drift which varies with the angle of elevation of the firearm and needs to be compensated in order to have effective and precise targeting. This is the case for the MK-19 grenade machine gun mentioned above. Accordingly, there exists a need for an accessory mount for releasably securing at least one accessory directly on a firearm which automatically compensates for the lateral drift while varying the angle of elevation of the accessory.

SUMMARY OF INVENTION

It is therefore an aim of the present invention to provide an accessory mount for releasably securing at least one accessory to a firearm which allows for adjustment of the accessory about two axes.

It is another aim of the present invention to provide an accessory mount for releasably securing at least one accessory to a firearm which automatically adjusts an azimuth of the accessory when the angle of elevation thereof is varied to compensate for a lateral drift of the firearm.

It is a further aim of the present invention to provide an accessory mount for releasably securing at least one accessory directly on a firearm which includes a system for dampening the recoil force produced by the firearm.

Therefore, in accordance with the present invention, there is provided an accessory mount for releasably securing at least one accessory to a firearm, the mount comprising a connecting portion attachable to the firearm, a first member connected to the connecting portion, the first member being rotatable with respect to the connecting portion about a first axis substantially perpendicular to a firing direction of the firearm, a second member connected to the first member, the second member being rotatable with respect to the first member about a second axis substantially perpendicular to the first axis, and a first attachment system connected to the second member for releasably receiving a first of the at least one accessory.

Also in accordance with the present invention, there is provided an accessory mount for releasably securing at least one accessory to a firearm, the mount comprising a base portion attachable to the firearm, a body portion engaged to the base portion to be slidable along a first axis substantially parallel to a firing direction of the firearm, an attachment portion connected to the body portion for releasably receiving the at least one accessory, and a dampener system connected to the base and body portions, the dampener system acting along the first axis to dampen a recoil force produced by the firearm.

Further in accordance with the present invention, there is provided an accessory mount for releasably securing at least one accessory to a firearm, the mount comprising a connecting portion attachable to the firearm, an attachment portion releasably receiving the at least one accessory and connected to the connecting portion to allow a first rotation varying an azimuth of the at least one accessory and a second rotation varying an angle of elevation of the at least one accessory, and control means adjusting the second rotation to obtain a desired value of the angle of elevation of the at least one accessory and automatically producing the first rotation to correct a lateral drift of the firearm.

BRIEF DESCRIPTION OF THE DRAWINGS

Reference will now be made to the accompanying drawings, showing by way of illustration a preferred embodiment of the present invention and in which.

DESCRIPTION OF THE PREFERRED EMBODIMENTS

Figure 1:
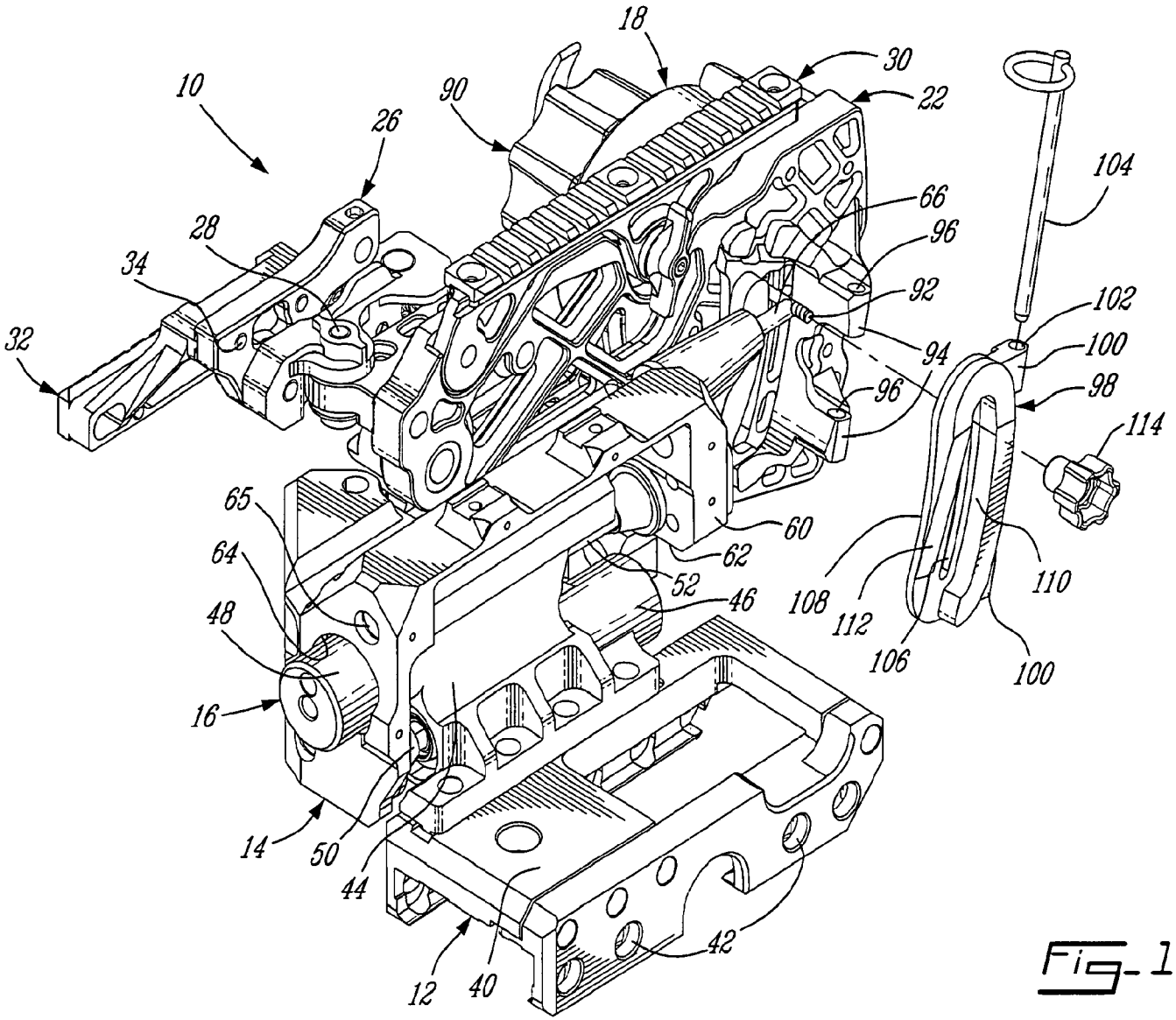
FIG. 1 is a perspective view of a mount according to a preferred embodiment of the present invention showing a relative position between a body and base corresponding to a forward reaction force after a recoil of the firearm, and with an exploded portion showing a mounting of a control system providing no lateral drift correction.
Figure 2:
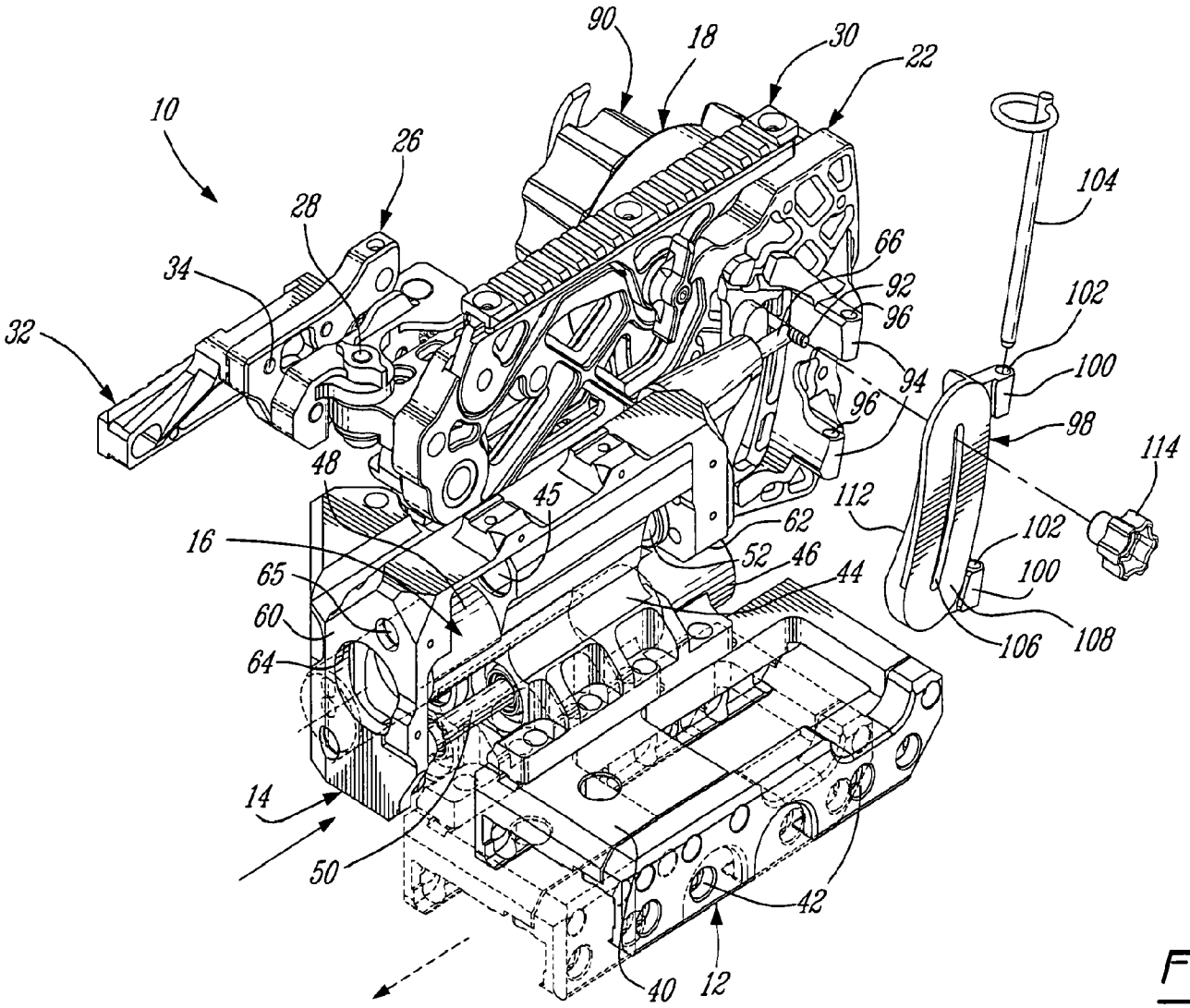
FIG. 2 is a perspective view of the mount of FIG. 1 showing the relative position between the body and base corresponding to the recoil of the firearm, with an exploded portion showing a mounting of the control system providing a lateral drift correction.
Figure 10:
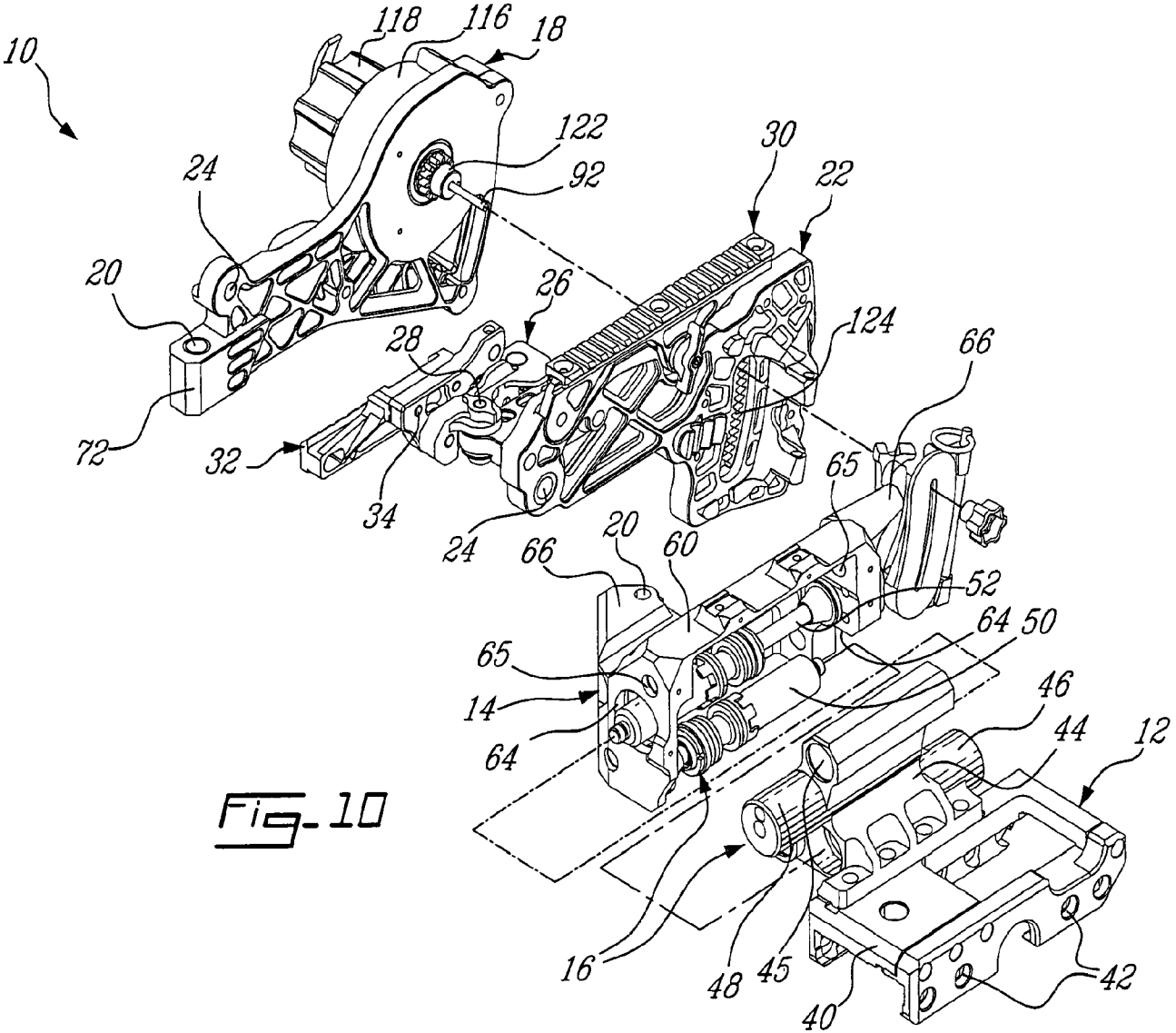
FIG. 10 is a perspective exploded view of the mount of FIG. 2 showing the various main components thereof.

Referring now generally to FIGS. 1, 2 and 10, an accessory mount according to a preferred embodiment of the present invention is shown at 10. The mount 10 comprises a base 12 and a body 14 which are slidingly connected together through a dampening system 16 to form a connecting portion of the mount 10. The mount 10 also comprises an attachment portion including a first element 18 connected to the body 14 by a first pivot 20, a second element 22 connected to the first element 18 by a second pivot 24, and a third element 26 connected to the second element 22 by a third pivot 28.

The first pivot 20 provides a rotation about an axis perpendicular to the longitudinal axis of the base 12, which corresponds to the firing direction of the firearm, such that the first element 18 rotates in a substantially horizontal plane when the firing direction is substantially horizontal. The second pivot 24 provides a rotation about an axis perpendicular to the axis of the first pivot 20, such that the second element 22 rotates in a plane perpendicular to the plane of rotation of the first element 18. The third pivot 28 provides a rotation about an axis perpendicular to the axis of the second pivot 24 such that the third element 26 rotates in a plane perpendicular to the plane of rotation of the second element 22.

Referring to FIGS. 1-2, a first attachment system 30 is connected to the second element 22, and a second attachment system 32 is connected to the third element 26. Both attachment systems 30,32 are standard accessory attachment systems, such as Picatinny-type rails which are composed of a series of spaced apart ribs. Preferably, the first attachment system 30 is directly connected to the second element 22 while the second attachment system 32 is connected to the third element 26 through a fourth pivot 34. The fourth pivot 34 provides a rotation about an axis perpendicular to the axis of the third pivot 28, such that the second attachment system 32 rotates in a plane perpendicular to the plane of rotation of the third element 26.

Figure 6:
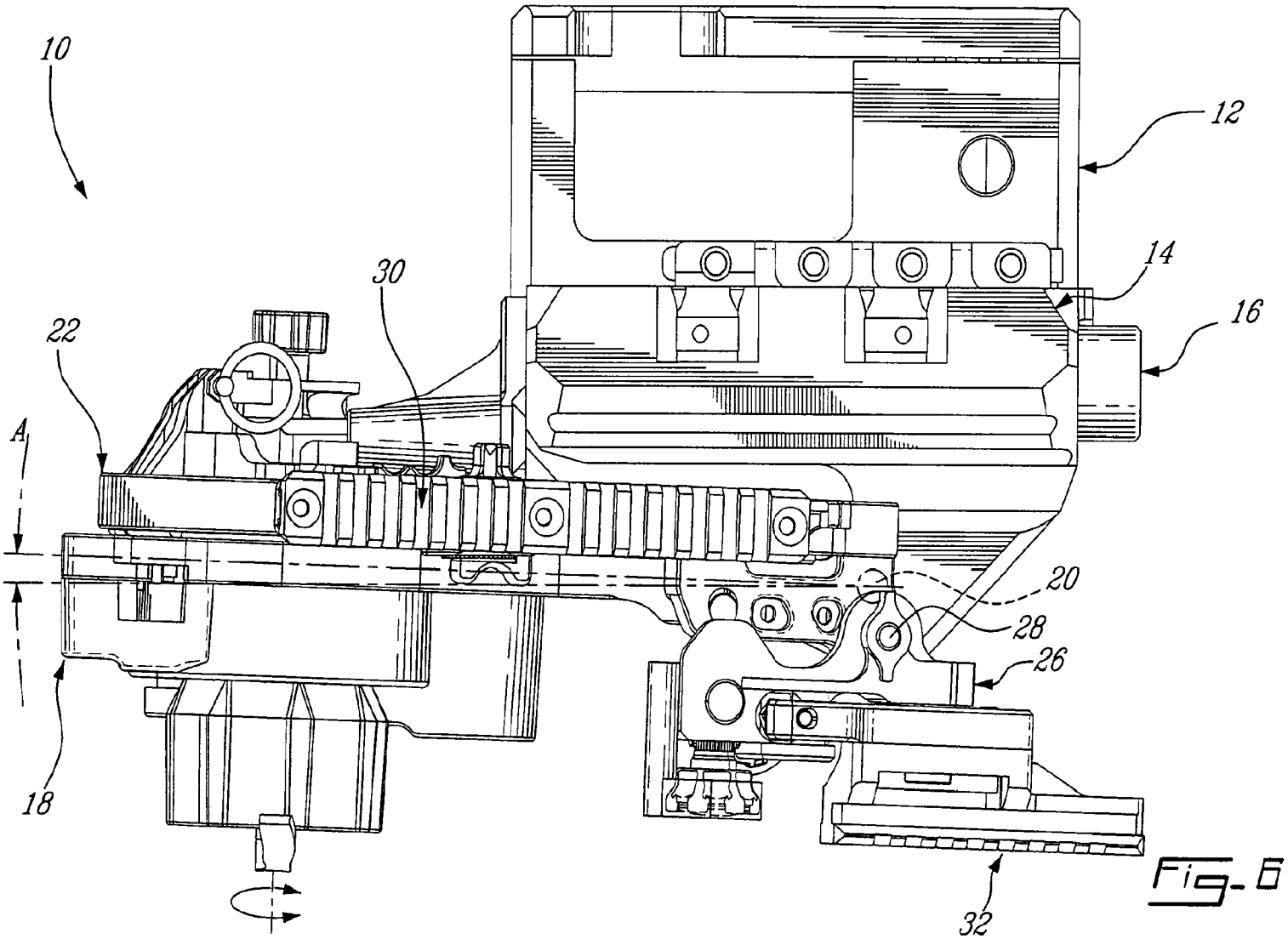
FIG. 6 is a top view of the mount of FIG. 2 showing a first simultaneous azimuth adjustment of first and second attachment systems providing the lateral drift correction.
Figure 7:
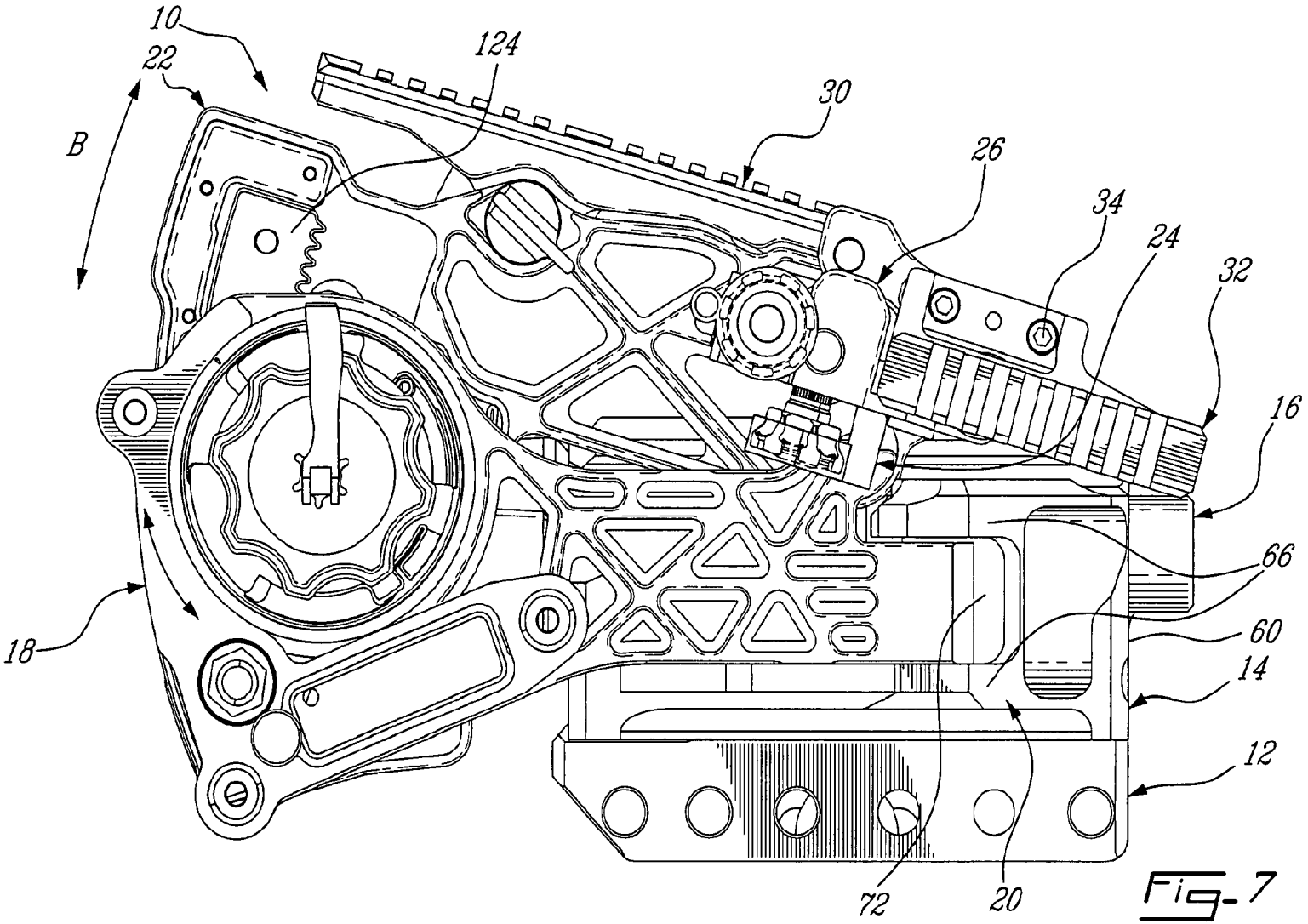
FIG. 7 is a side view of the mount of FIG. 1 or 2 showing a first simultaneous adjustment of the angle of elevation of the first and second attachment systems.
Figure 8:
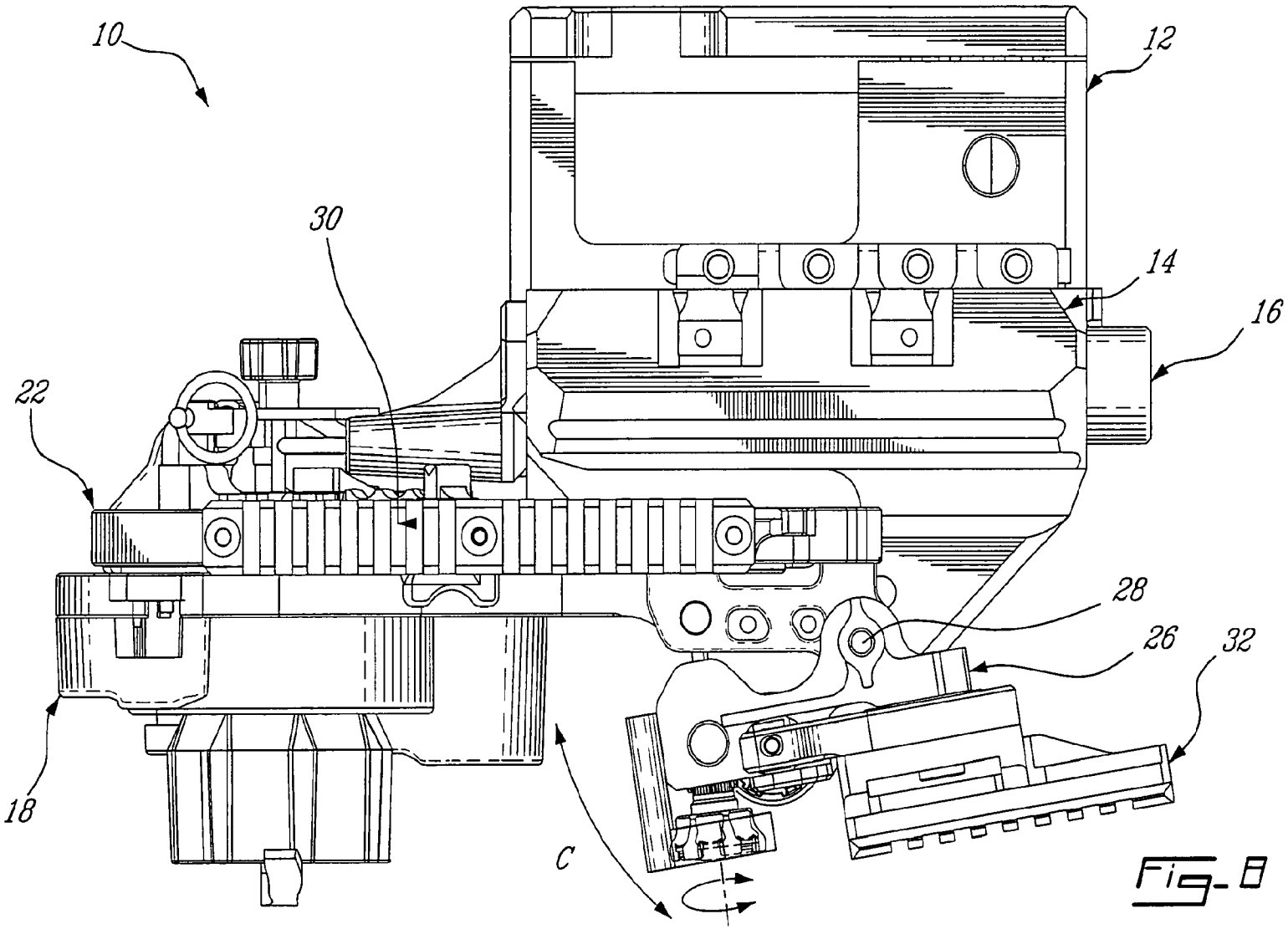
FIG. 8 is a top view of the mount of FIG. 2 showing a second azimuth adjustment of the second attachment system.
Figure 9:
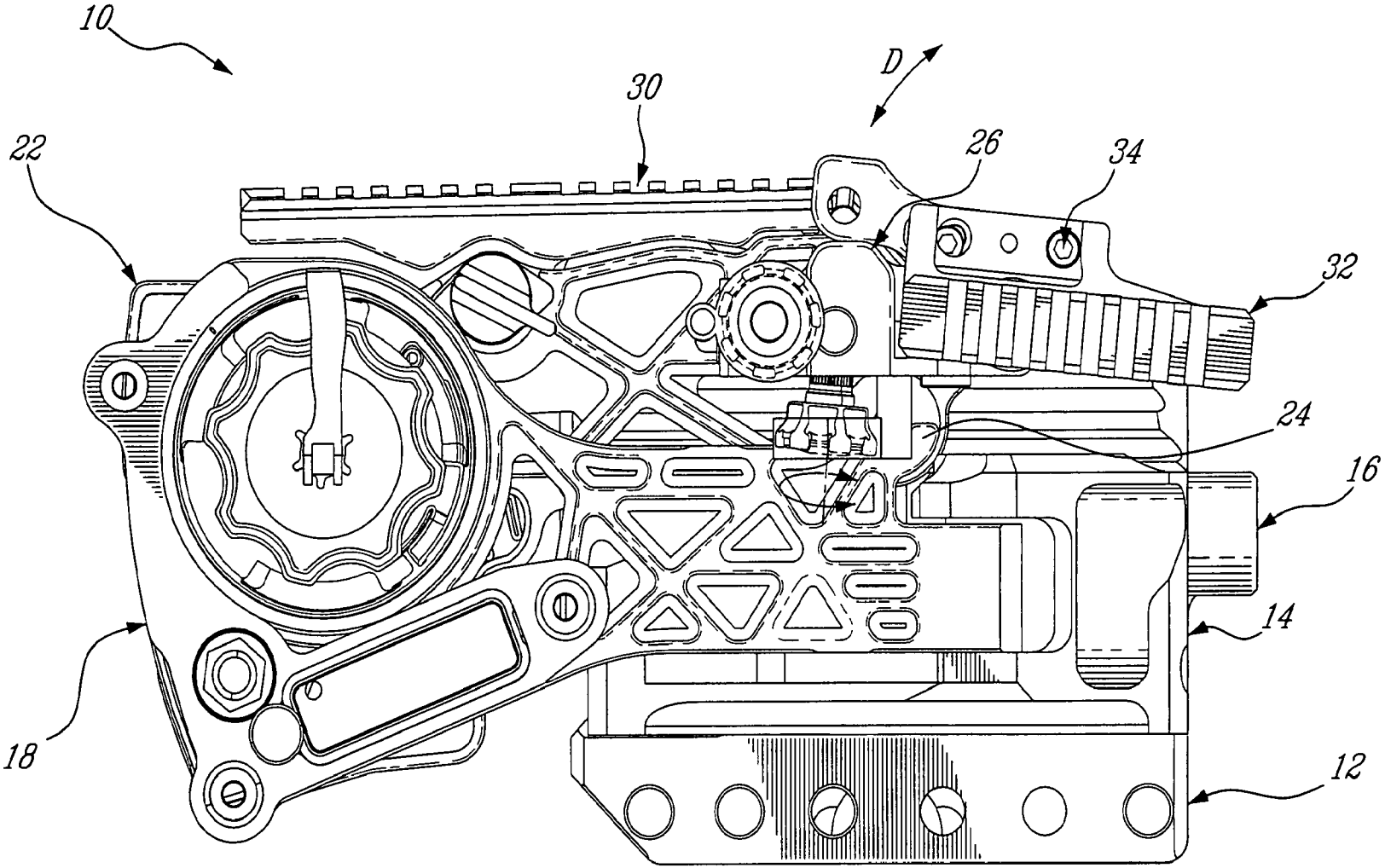
FIG. 9 is a side view of the mount of FIG. 1 or 2 showing a second adjustment of the angle of elevation of the second attachment system.

The mount 10 thus provides for a variety of adjustments for accessories mounted thereon. As shown in FIG. 6, rotation about the first pivot 20 provides a first simultaneous azimuth adjustment "A" of the first and second attachment systems 30,32 through the first, second and third elements 18,22,26. As shown in FIG. 7, rotation about the second pivot 24 provides for a first simultaneous angle of elevation adjustment "B" for the first and second attachment systems 30,32 through the second and third elements 22,26. As can be seen in FIG. 8, rotation about the third pivot 28 provides a second azimuth adjustment "C" for the second attachment system 32 through the third element 26. Finally, as can be seen in FIG. 9, rotation about the fourth pivot 34 provides a second angle of elevation adjustment "D" for the second attachment system 32.

The various components of the mount 10 will now be described in more details.

As can be best seen in FIGS. 1, 2 and 10, the base 12 includes a rail portion 40 which is adequately shaped to engage a given firearm (not shown). The rail portion 40 is adapted to be securely mounted to the firearm such as by fasteners or the like. Holes 42 are provided in the rail portion 40 for air circulation purposes. An arm 44 is releasably fastened onto the rail portion 40 by means of bolts or the like and can be readily detached from the rail portion 40 whenever it is desired to install the mount 10 on another firearm equipped with a rail similar to the rail portion 40.

The arm 44 includes a top cylindrical bore 45 as well as part of the dampening system 16, namely first and second hydraulic cylinders 46,48. The first and second hydraulic cylinders 46,48 respectively receive first and second pistons 50,52. The pistons 50,52 each have one end inside the respective cylinder 46,48 and another end secured to the body 14. The hydraulic cylinders 46,48 and pistons 50,52 are parallel to the firing direction of the firearm such that the pistons 50,52 extend out of the cylinders 46,48 in opposite directions from each other. This allows for dampening to occur both during the recoil (see FIG. 2) and the reaction forward movement (see FIG. 1) following it. Although hydraulic dampeners are illustrated, it is also considered to use alternative dampening systems.

As can also be best seen in FIGS. 1, 2 and 10, the body 14 includes a housing 60 defining a cavity for receiving the dampening system 16, as well as first and second circular openings 62,64 in the housing 60 to accommodate the movement of the first and second hydraulic cylinders 46,48, respectively. The housing 60 also includes first and second aligned holes 65, which are aligned with the cylindrical bore 45 of the base 12 to receive a shaft (not shown) slidingly engaging the base 12 and the body 14. A guide 66 extends from the housing 60 in a direction parallel to the firing direction of the firearm. The guide 66 is shaped as a shaft having a grooved end. As seen in FIGS. 7 and 10, the housing 60 also includes a pair of lugs 66 which form part of the first pivot 20.

Figure 3:
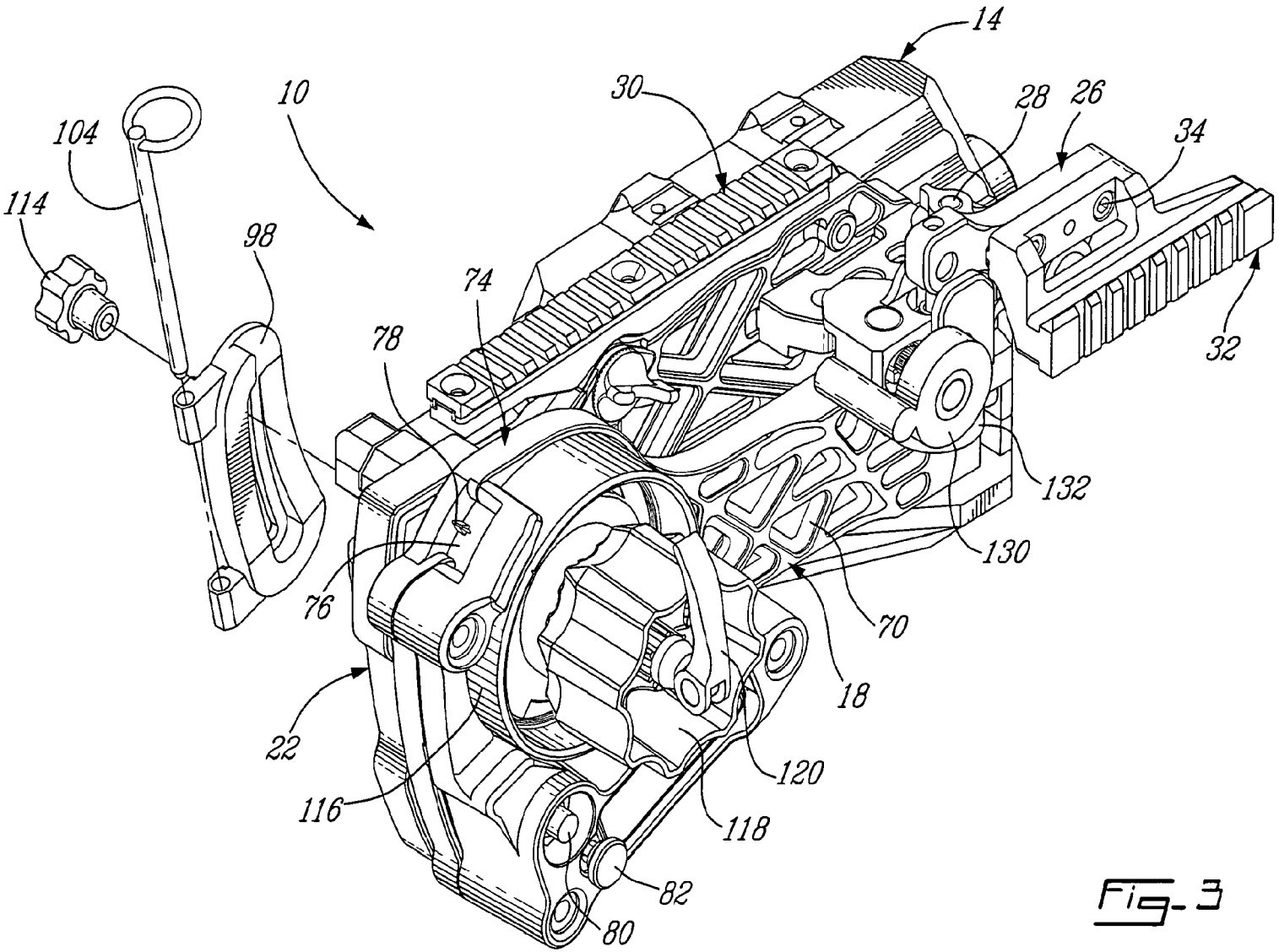
FIG. 3 is a perspective view, partly exploded, of the mount of FIG. 2 from an opposed point of view and showing knob covers in place over adjustment knobs.

As can be seen in FIG. 3, the first element 18 preferably includes a series of holes 70 to minimize a weight thereof. The first element 18 includes a lug 72 (see FIGS. 7 and 10) which is attached to the lugs 66 of the body 14 by a pin (not shown) to form the first pivot 20. The first element 18 also includes a control system receiving portion 74 which includes a window 76 having a pointer 78 and a light (not shown) therein. The light is preferably mounted in a recess in a side wall of the window 76 to minimize light emissions outside of the window 76. The first element 18 further includes a push button 80 for activating the light, and a closable battery casing 82 for receiving a battery powering the light.

As seen in FIGS. 1-2, a control system generally shown at 90 allows a user to adjust the rotation of the second element 22 about the second pivot 24. The control system 90 includes a shaft 92 which is rotationally retained by the first element 18 and by the guide 66, and passes through the second element 22 located therebetween (see FIG. 10). The shaft 92 is threaded on the end retained by the guide 66. The second element 22 includes a pair of lugs 94 with aligned bores 96 near the shaft 92. An arcuate plate 98 includes similar lugs 100 with aligned bores 102 which are engaged to the lugs 94 of the second element 22 by a pin 104 going through the aligned bores 96,102. The guide 66 is thus sandwiched between the mounted arcuate plate 98 and the second element 22. The arcuate plate 98 includes an arcuate slot 106 and has one flat side 108 and one side defining an arcuate groove 110 surrounded by an inclined plane 112. A retaining knob 114 engages the threaded end of the shaft 92 over the arcuate plate 98.

As can be best seen in FIG. 3, the other end of the shaft 92 is keyed to a dial 116 having numerical indications usually indicating a target distance (not shown) aligned with the window 76, to an adjustment knob 118 having a profile easily grasped by a user, and to a standard quick locking system 120 which, when engaged, prevents the rotation of the shaft 92. Preferably, the dial 116 is reversible and includes two sets of numerical indications corresponding to two different firearms. The numerical indications are disposed so that only one set is visible through the window 76.

As can be best seen in FIGS. 7 and 10, the shaft 92 supports a gear 122 which is keyed thereto. The second element 22 includes an arcuate gear member 124 which is meshed with the gear 122. The arcuate gear member 124, as well as the arcuate slot and groove 106,110 of the installed plate 98, each define an arc of circle having its center at the second pivot 24.

The control system 90 allows the user to adjust the rotation of the second element 22 by turning the adjustment knob 118 until a desired numerical indication on the dial 116 is aligned with the pointer 78 in the window 76. Turning the adjustment knob 118 turns the gear 122 through the shaft 92, which activates the rotation of the second element 22 by rotating the arcuate gear member 124 about the second pivot 24, thus varying the angle of elevation of the first and second attachment systems 30,32. The user can than lock the second element 22 at the desired angle of elevation by engaging the quick locking system 120.

The control system 90 also produces an automatic correction of a lateral drift of the firearm. As explained above, the guide 66 is sandwiched between the arcuate plate 98 and the second element 22, such as to be snugly received in a channel formed between the two. When the arcuate plate 98 is mounted as shown in FIG. 2, i.e. with the inclined plane 112 in contact with the guide 66, the channel thus created forms an angle with respect to the plane of rotation of the second element 22. As the second element 22 is rotated about the pivot 24, the guide 66 sliding in the angled channel will force a rotation of the first element 18 about the first pivot 20.

In the case where no lateral drift correction is required, the arcuate plate 98 is mounted as shown in FIG. 1, i.e. with the flat side 108 against the guide and the retaining knob 118 sliding on a flat surface within the arcuate groove 110. As the second element 22 is rotated about the second pivot 66, the guide 66 will thus slide in a channel parallel to the plane of rotation of the second element 22. In that case, no rotation will occur about the first pivot 20 and the first element 18 and body 14 will act as an integral member.

Figure 4:
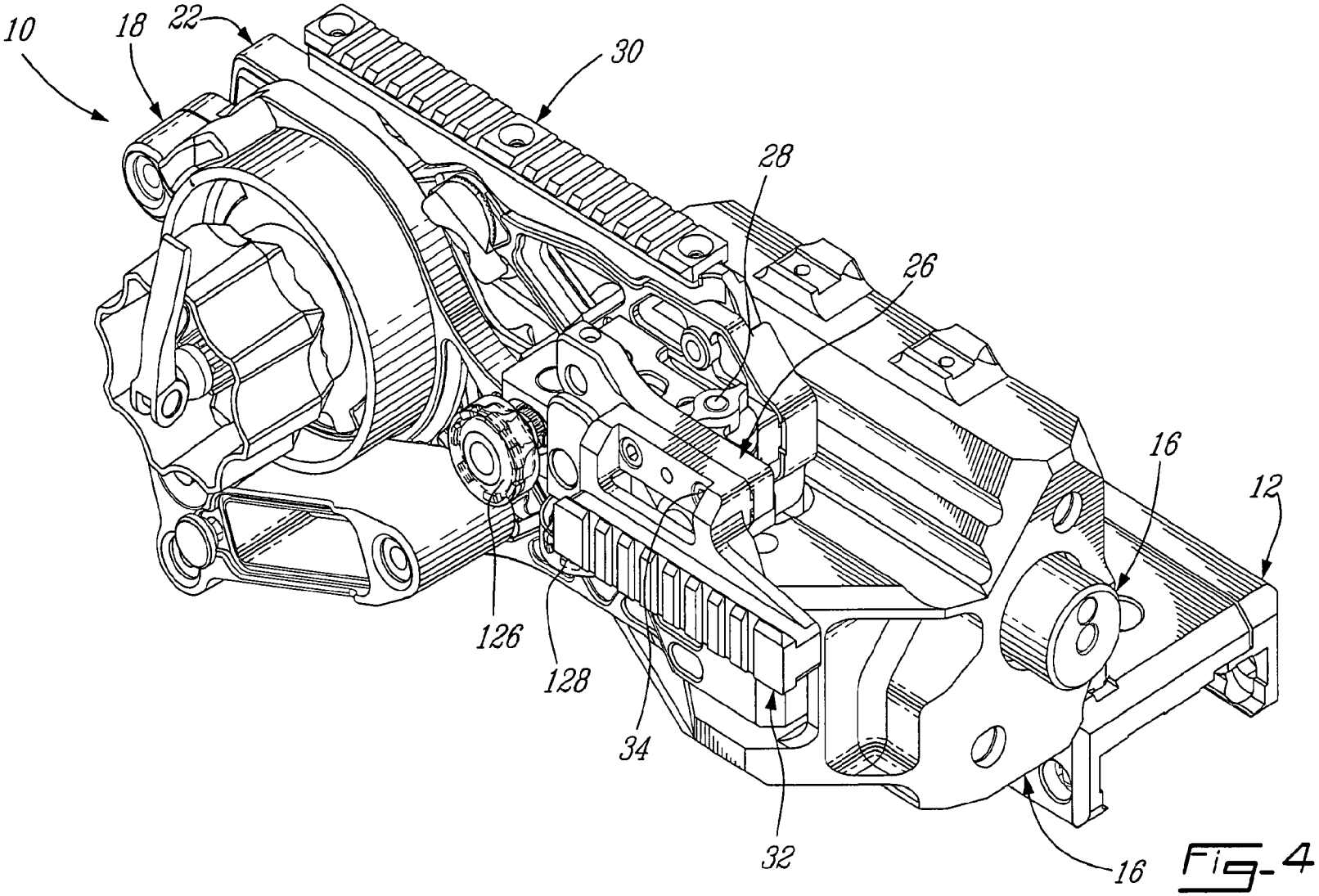
FIG. 4 is a perspective view of the mount of FIG. 3 from an alternative point of view and showing the adjustment knobs without the knob covers.
Figure 5:
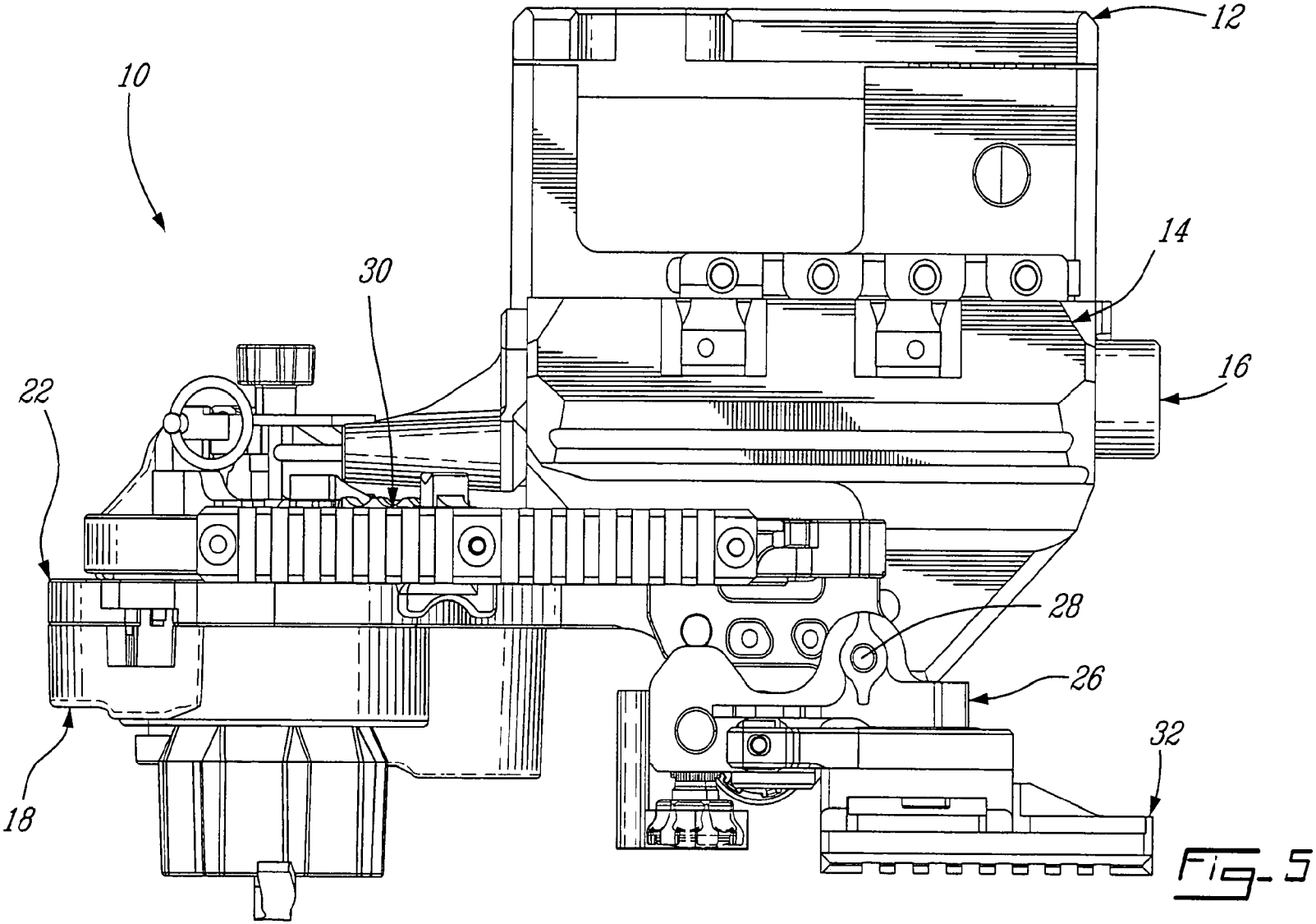
FIG. 5 is a top view of the mount of FIG. 2.

As shown in FIG. 4, the user can also adjust the rotation of the third element 26 about the third pivot 28 by turning a small knob 126. The small knob 126 is keyed onto a threaded shaft (not shown), which is retained in the third element 26 and threadably received in the second element 22. Similarly, the user can adjust the rotation of the second adjustment system 32 about the fourth pivot 34 by turning a second small knob 128. The second small knob 128 is keyed onto a second threaded shaft (not shown) which is similarly retained in the third element 26 and threadably received in the second adjustment system 32. As shown in FIG. 3, each of the small knobs 126,128 is equipped with a removable knob cover 130,132 which, when engaged over the respective knob 126,128, prevents the knob 126,128 from being accidentally turned.

In operation, the user determines if the firearm to be used requires a lateral drift correction and mounts the arcuate plate 98 accordingly. The user then attaches the mount 10 to the firearm through the rail portion 40, and desired accessories to the first and second attachment systems 30,32. The user first adjusts the angle of elevation of the accessories by turning the adjustment knob 118 until a desired numerical indication of the dial 116 is aligned with the pointer 78 in the window 46. If needed, the user can press the push button 80 such as to activate the light in the window 76 to better see the numerical indications on the dial 116. Turning the adjustment knob 118 will simultaneously rotate the second and third elements 22,26 about the second pivot 24 through the action of the gear 122 and arcuate gear member 124. When the desired orientation of the second element 22 is obtained, the quick locking system 120 is engaged to prevent accidental rotation of the control system 90.

If the arcuate plate 98 is mounted as shown in FIG. 2, turning the adjustment knob 118 will also provide the lateral drift correction by simultaneously rotating the first, second and third elements 18,22,26 about the first pivot 20 through the action of the guide 66 and inclined plane 112 of the arcuate plate 98. If the arcuate plate 98 is mounted as shown in FIG. 1, no rotation will occur about the first pivot 20 and the first element 18 will form an integral member with the body 14.

The user can then adjust the azimuth and angle of elevation of the accessory mounted onto the second attachment system 32 by turning the small knobs 126,128 which will respectively rotate the third element 26 about the third pivot 28 and the second attachment system 32 about the fourth pivot 34. Once the desired orientation is obtained, the knob covers 130,132 are engaged to the small knobs 126,128 to prevent accidental rotation thereof.

When the firearm is fired, the recoil force as well as the reaction forward force will be dampened by the dampening system 16. This will minimize the risk of injury to the user by limiting the range and speed of the movement of the accessories caused by the recoil of the firearm.

The various user controls of the mount 10 (i.e. the knobs 118,126,128, the quick locking system 120, the knob covers 130,132, the push button 80) are disposed and designed such as to be operable with a single hand, thus simplifying the use of the mount 10.

The present invention thus provides for releasable attachment of at least one accessory directly to a firearm while providing separate adjustment of two accessories with respect to a firing direction about at least two axes.

The present invention also advantageously provides lateral drift correction when needed while being usable with firearms requiring no lateral drift correction.

The present invention further provides a dampening system dampening the recoil force produced by a firearm, such that accessories can be mounted directly on firearms producing a significant recoil force while minimizing the risks of injury to the user.

The embodiments of the invention described above are intended to be exemplary. Those skilled in the art will therefore appreciate that the foregoing description is illustrative only, and that various alternatives and modifications can be devised without departing from the spirit of the present invention. Accordingly, the present invention is intended to embrace all such alternatives, modifications and variances which fall within the scope of the appended claims.

The invention claimed is:

1. An accessory mount for releasably securing at least one accessory to a firearm, the mount comprising:

a connecting portion attachable to the firearm;

a first member connected to the connecting portion, the first member being rotatable with respect to the connecting portion about a first axis substantially perpendicular to a firing direction of the firearm;

a second member connected to the first member, the second member being rotatable with respect to the first member about a second axis substantially perpendicular to the first axis; and a first attachment system connected to the second member for releasably receiving a first of the at least one accessory, wherein the first axis is oriented so that a rotation of the first member varies an azimuth of the first accessory and the second axis is oriented so that a rotation of the second member varies an angle of elevation of the first accessory; and a control system for adjustably rotating the second member about the second axis, the control system including a knob keyed on a shaft driving a gear drivingly engaged with an arcuate gear portion provided on the second member, and a quick locking system for selectively locking the shaft against rotation.

2. The mount of claim 1, further comprising a second attachment system connected to the first member for releasably receiving a second of the at least one accessory, the rotation of the first member also varying an angle of elevation of the second accessory.

3. The mount of claim 1, wherein the second member includes an angled channel and the connecting portion includes a guide, the guide being slidably received in the angled channel to slide therein during the rotation of the second member, the angled channel being oriented such that the sliding of the guide therein forces the first and second members to move with respect to the connecting portion to automatically produce the rotation of the first member.

4. The mount of claim 1, further comprising a third member connected to the second member, the third member being rotatable with respect to the second member about a third axis substantially perpendicular to the second axis, and a second attachment system connected to the third member for releasably receiving a second of the at least one accessory.

5. The mount of claim 4, wherein the third axis is oriented so that a rotation of the third member varies the azimuth of the second accessory.

6. The mount of claim 5, wherein the second attachment system is rotatable with respect to the third member about a fourth axis oriented so that a rotation of the second attachment system varies the angle of elevation of the second accessory.

7. The mount of claim 1, wherein the connecting portion includes a base and a body, the base being attachable to the firearm and the body being connected to the first member, the body being slidable with respect to the base along the firing direction of the firearm, and the mount further comprises a dampener system between the base and body acting along the firing direction to dampen a recoil force produced by the firearm.

8. The mount of claim 1, wherein the angle of elevation can be varied within a range of at least 27 degrees.

9. An accessory mount for releasably securing at least one accessory to a firearm, the mount comprising:

a connecting portion attachable to the firearm;

a first member connected to the connecting portion, the first member being rotatable with respect to the connecting portion about a first axis substantially perpendicular to a firing direction of the firearm;

a second member connected to the first member, the second member being rotatable with respect to the first member about a second axis substantially perpendicular to the first axis;

a first attachment system connected to the second member for releasably receiving a first of the at least one accessory, a third member connected to the second member, the third member being rotatable with respect to the second member about a third axis substantially perpendicular to the second axis, and a second attachment system connected to the third member for releasably receiving a second of the at least one accessory, wherein the first axis is oriented so that a rotation of the first member varies an azimuth of the first and second accessories, the second axis is oriented so that a rotation of the second member varies an angle of elevation of the first and second accessories, and the third axis is oriented so that a rotation of the third member varies the azimuth of the second accessory.

* * * * *